US005847295A

United States Patent [19]

Klepacki

[11] Patent Number: 5,847,295

[45] Date of Patent: Dec. 8, 1998

[54] TUNING DEVICE FOR STRING INSTRUMENTS

[76] Inventor: David A. Klepacki, 1129 Stevenson Rd., Ashtabula, Ohio 44004-9153

[21] Appl. No.: 642,043

[22] Filed: May 6, 1996

[51] Int. Cl.[6] ..... G10D 3/14

[52] U.S. Cl. ..... 84/305; 84/304; 84/306

[58] Field of Search ..... 84/304, 305, 306

[56] References Cited

U.S. PATENT DOCUMENTS

| | | | |
|---|---|---|---|
| 528,013 | 10/1894 | McKenze | 84/305 |
| 1,548,777 | 8/1925 | Cuoghi | 84/305 |
| 4,014,239 | 3/1977 | Spercel | 84/306 |
| 4,515,059 | 5/1985 | Siminoff | 84/306 |
| 4,528,887 | 7/1985 | Frederick | 84/306 |
| 5,277,095 | 1/1994 | Steinberger | 84/304 |
| 5,381,715 | 1/1995 | Spencel | 84/304 |
| 5,390,579 | 2/1995 | Burgon | 84/454 |

*Primary Examiner*—Michael L. Gellner
*Assistant Examiner*—Shih-yung Hsieh
*Attorney, Agent, or Firm*—David L. Volk; John D. Gugliotta

[57] ABSTRACT

An improved attachment means for attaching a tuning device to a stringed instrument is disclosed. With a tuning device having a housing forming an integral cylindrical portion, a gusset is affixed to the housing extending in an angular line into a mating groove provided in the lower side of the instrument head of equal angularity to said gusset.

4 Claims, 3 Drawing Sheets

PRIOR ART

TUNING DEVICE FOR STRING INSTRUMENTS

BACKGROUND OF THE INVENTION

1. Field of the Invention

The present invention relates generally to devices for tuning musical string instruments, such as the guitar, and, more particularly, to an improved method of attachment of such tuning devices to such musical string instruments.

2. Description of the Related Art

Many methods and devices for tuning musical string instruments are known. For instance, U.S. Pat. No. 5,390,579, issued in the name of Burgon, discloses an apparatus for tuning of musical instruments. Also, in U.S. Pat. No. 5,381,715, issued in the name of Spercel, a tuning device is disclosed. And again, in U.S. Pat. No. 4,014,239, issued in the name of Spercel, a guitar string tuning device is disclosed. And, disclosed in U.S. Pat. No. 5,277,095, issued in the name of Steinberger is a string tuner. However, tuning devices made in accordance with these references fail to accommodate easy string replacement. Moreover, these references also fail to provide a convenient means to directly turn the winding spindle at a one to one ratio.

Additionally, in U.S. Pat. No. 4,528,887, issued in the name of Frederick, and assigned to the inventor of the present invention, and which is hereby incorporated herein by reference in its entirety, addresses these problems in the relevant art and proposes solutions which involve a construction wherein the winding spindle or drum upon which the string is attached may be selectively and independently rotated on a one to one basis or on a high multiple to one basis.

However, problems have been associated with the attachment of such a device to an instrument in that a difficulty in maintaining the correct orientation of the tuning device with the instrument head have been encountered. Further, such a tuning device experiences rotation within its mounting hole in the instrument head should its clamping means loosen, thereby potentially damaging the instrument head.

Conventional tuning devices posses a flanged means of seating the tuning device upon the head of an instrument. A typical design provides one or more radially symmetrical extensions of this flange to provide means for attachment of an appropriate fastener, usually a screw, in concert with a nut or a threaded sleeve provided as an extension of the housing of the tunning device. Devices not possessing a flange extension depend entirely upon the clamping of the instrument head between the housing flange and sleeve or nut to maintain correct orientation of the device to the head.

Other methods of attachment are also disclosed in the above cited art. For example, in the '239 patent, a single flange extension is disclosed perpendicular to the worm gear and radially extending from the housing with relation to the centerline of the pinion gear. And, in the '715 patent, a housing is disclosed including a generally hexagonal mounting cap which clamps a washer against the upper side of the head. And, in the Frederick patent incorporated above by reference in its entirety, the tuning device is secured to the instrument head my means of a threaded bearing nut which is threaded to threads conventionally provided in a cylindrical extension of the housing. A protective washer is usually provided between the head of the nut and the instrument head.

Consequently, a need has been felt for providing an apparatus and method for attachment of a tuning device to a string instrument head which maintains the correct orientation of the tuning device, as well as prevents rotation of the tuning device.

SUMMARY OF THE INVENTION

It is therefore an object of the present invention to provide an improved tuning device for a musical string instrument.

It is another object of the present invention to provide an improved method of attachment of such tuning devices to such musical string instruments.

It is a feature of the present invention to provide an improved instrument tuning device having an improved means of attachment to an instrument head, thereby maintaining the correct orientation of the tuning device in relation to the instrument head as well as preventing the body of the tuning device from rotating within its mounting hole in the instrument head.

Briefly described according to one embodiment of the present invention, a tuning device is disclosed otherwise of the type described by U.S. Pat. No. 4,528,887, issued in the name of Frederick, but improved to include a gusset added to the mounting portion of the housing which provides a means of precision alignment as well as preventing rotation. Such an improvement additionally allows the tuning device to be attached to the instrument head in any conventional manner without the use of fasteners.

Briefly described in accordance with an alternate embodiment, a decorative base plate is additionally incorporated and held to the instrument head by impingement between the housing flange and the instrument head.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENTS

Figure 1:
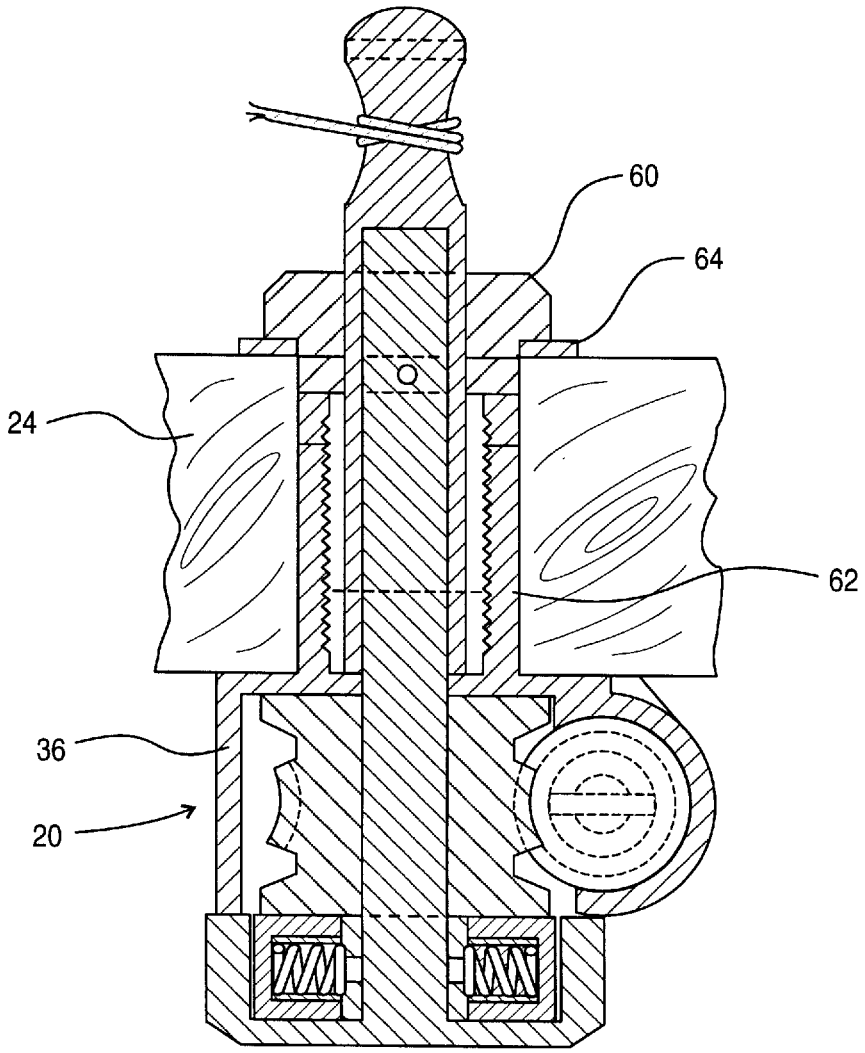
FIG. 1 is a front elevational view in section of a tuning device constructed in accordance with the prior art.

Referring now to FIG. 1, an improved tuning device of the type disclosed in the prior, incorporated art is shown. A housing 20 is provided forming an integral cylindrical portion 36. The tuning device is secured to the instrument head 24 by means of a threaded bearing nut 60 which is threaded to threads conventionally provided in a cylindrical extension 62 of housing 20. A protective washer 64 is typically provided between the head of nut 60 and the instrument head 24.

Figure 2:
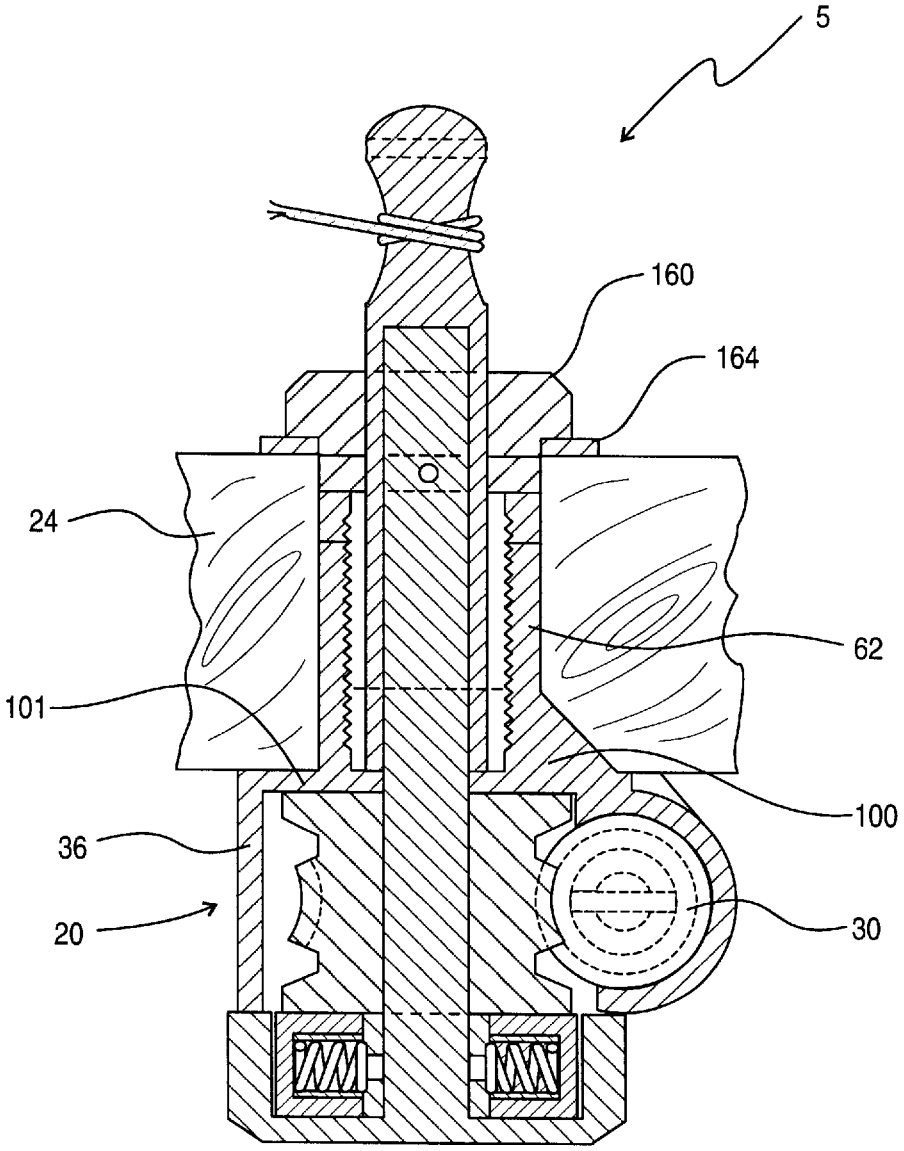
FIG. 2 is a front elevational view in section of a tuning device according to the preferred embodiment of the present invention.
Figure 3A:
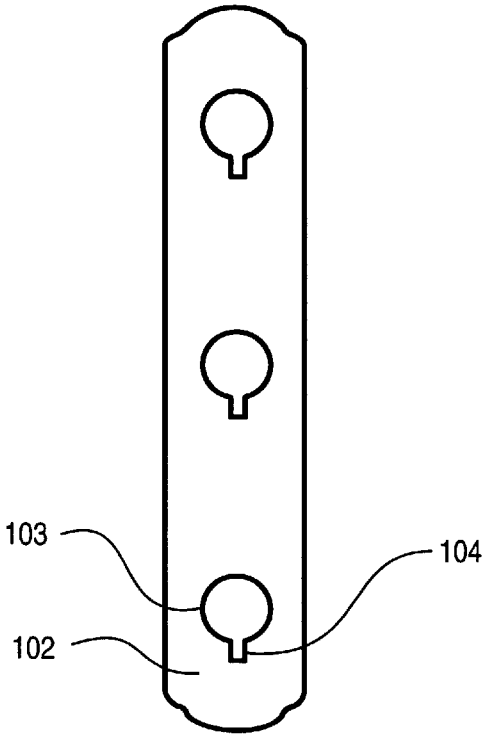
FIG. 3*a* is a top plan view of a decorative baseplate for use in conjunction with the preferred embodiment of the present invention.
Figure 3B:
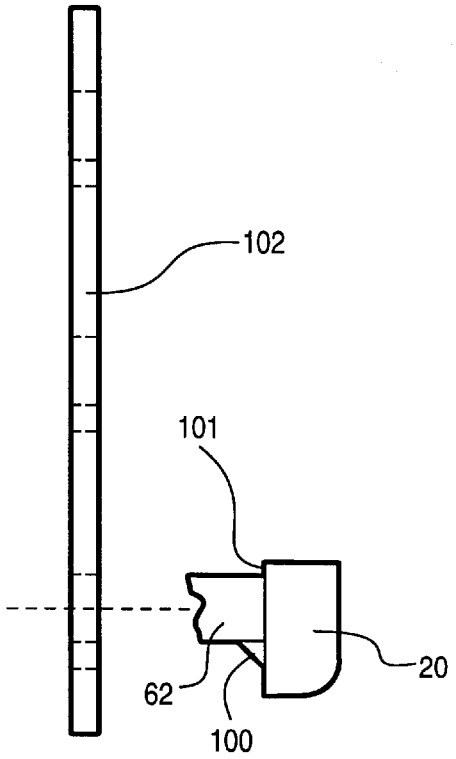
FIG. 3*b* is a side elevational view thereof shown in use with a tuning device as described in FIG. 2.
Figure 3C:
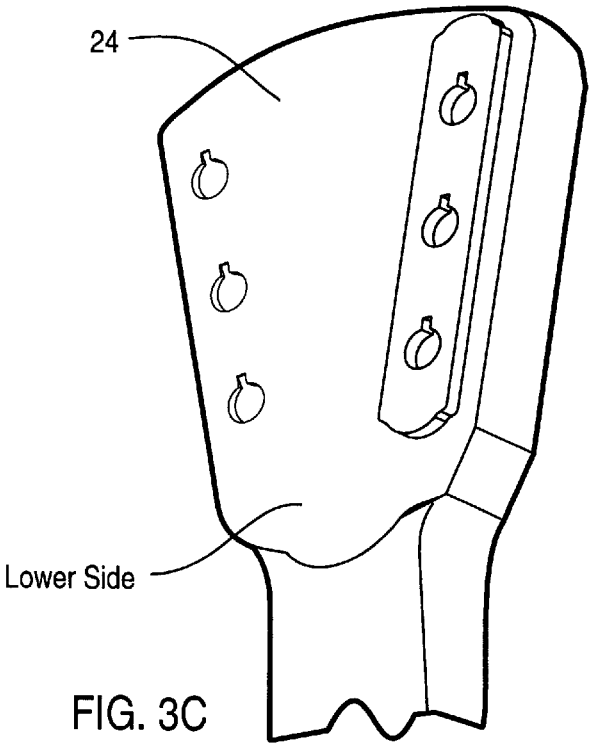
FIG. 3*c* is a perspective view of the decorative baseplate shown in FIG. 3*a* affixed to the head of a musical string instrument.

In FIG. 2, a tuning device 5 is shown incorporating the improved attachment means according the present invention by providing a gusset 100 as an integral part of the housing 20 extending from the housing flange 101. With relation to the centerline of worm gear 30 in an angular line to the cylindrical extension of the housing 62, a mating groove 104 (as shown in FIG. 3*a*) of equal angularity is provided in the lower side of the head 24 mounting hole so located as to provide correct orientation of the tuning device to the instrument head 24. Additionally, the device can also then be secured to the upper side of the head 24 by means of a nut or threaded sleeve 160, which may include a shake-proof washer 164 between the nut or threaded sleeve 160. The nut or threaded sleeve 160 is threaded to threads conventionally provided in the cylindrical extension 62 of the housing 20. However, should such fasteners become loosened, the tuning device 5 will maintain the correct orientation in relation to the instrument head 24, as well as be prevented from rotating or otherwise causing damage to the instrument head 24.

Referring to FIG. 3*a,* 3*b,* and 3*c,* an alternate embodiment of the present invention in which a decorative base plate 102 is clamped between the housing flange 101 and instrument head 24 in a conventional manner as described above. The baseplate 102 forms a plurality of mounting holes 103, the number of which is determined by the number of strings on the instrument. Each mounting hole 103 is of the same dimension as the mounting hole in the instrument head 24. Each hole 103 further possesses a groove 104 for mating with gusset 100 and so located as to provide correct orientation of the tuning device to the head 24.

The foregoing description of the preferred embodiment of the present invention has been presented for purposes of illustration and description. It is not intended to be exhaustive or to limit the present invention to the precise form disclosed, and obviously many modifications and variations are possible in light of the above teachings. The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. An improved attachment means for attaching a tuning device having a worm gear to the head of a stringed instrument having a mounting hole, said attachment means comprising:

a housing forming an integral cylindrical portion containing a housing flange and a cylindrical extension;

a gusset affixed to said housing flange and to said cylindrical extension, said gusset extending from said housing flange in an angular line in relation to the centerline of the worm gear, in an angular line to the cylindrical extension of the housing;

a mating groove provided in the lower side of the head of equal angularity to said gusset, said mating groove extending from said mounting hole such as to provide correct orientation of the tuning device to the instrument head.

2. The improved attachment means as described in claim 1, further comprising:

threads conventionally provided in the cylindrical extension of the housing; and a nut for threadingly engaging said threaded cylindrical extension in a manner such as to impinge said instrument head between said nut and said housing.

3. The improved attachment means as described in claim 2, further comprising:

a washer mounted between said nut and said instrument head about said threaded sleeve for protecting said instrument head from stresses applied thereto by said nut.

4. The improved attachment means as described in claim 2, further comprising:

a decorative base plate clamped between said housing and said instrument head, said baseplate forming a plurality of mounting holes, the number of which is determined by the number of strings on the instrument, and wherein each said mounting hole further possesses a groove for mating with said gusset and located so as to provide correct orientation of said tuning device with relation to said instrument head.

* * * * *